US007040829B2

(12) United States Patent
Lin

(10) Patent No.: US 7,040,829 B2
(45) Date of Patent: May 9, 2006

(54) PEN WITH PAPER DISPENSER

(76) Inventor: Chao-Jen Lin, P.O. Box No. 6-57, Junghe, Taipei 235 (TW)

( * ) Notice: Subject to any disclaimer, the term of this patent is extended or adjusted under 35 U.S.C. 154(b) by 131 days.

(21) Appl. No.: 10/768,122

(22) Filed: Feb. 2, 2004

(65) Prior Publication Data

US 2005/0100393 A1 May 12, 2005

(30) Foreign Application Priority Data

Nov. 6, 2003 (TW) ..... 92219678 U

(51) Int. Cl.
*B43K 29/00* (2006.01)

(52) U.S. Cl. ..... 401/195; 401/52

(58) Field of Classification Search ..... 401/195, 401/52
See application file for complete search history.

(56) References Cited

U.S. PATENT DOCUMENTS 2,099,268 A * 11/1937 Henson et al. ..... 401/52
4,812,069 A * 3/1989 White et al. ..... 401/195

* cited by examiner

*Primary Examiner*—Khoa D. Huynh
(74) *Attorney, Agent, or Firm*—Troxell Law Office, PLLC

(57) ABSTRACT

A paper dispenser includes a reel tube having a lateral opening and a cavity, a central shaft disposed inside the cavity, a set of spring for shaft with one end inserted and fixed on the central shaft while the other end is connected with the beginning end of the reel. The spring set for shaft rotates in accordance with the central shaft and can release paper through the lateral opening or furl paper back to the cavity. An annular leafspring set for the paper roll is installed between the reel tube and the spring set for shaft. When paper is released, the stretching force of the spring set for shaft along radial direction pulls the paper roll out. When the paper roll is curled back to the tube, the compressing force of the spring set for shaft along radial direction provides part of the cavity for receiving paper.

21 Claims, 5 Drawing Sheets

PEN WITH PAPER DISPENSER

BACKGROUND OF THE INVENTION

1) Field of the Invention

The present invention relates to an integral pen, especially to a pen with a paper dispenser.

2) Description of the Prior Art

In general, pens are used as writing utilities while papers can act as a carrier for words and other messages. We need both of them, never one without the other. However, people always only carry a pen with them, not a piece of paper. Once we need to write down something, it's difficult to get a piece of paper immediately. There is a need for improvement. Therefore, people have tried to combine a pen with paper. A certain length of paper is rewound into a reel and mounted into the pen.

However, it's important to retrieve the paper easily or smoothly. According to the Taiwanese patent No. 74201018 "easy pen with paper magazine", there is a huge opening of the penholder for pulling out the paper therefrom. Such kind of design ruins the appearance of the pen. Refer to the Taiwanese patent No. 81206055 "ball pen housing a supply of paper", it provides a leading edge of the paper for being pulled out of the housing and a mechanism preventing the paper from turning backwards. But that mechanism can rotate in single direction without the function of withdrawing the paper back. As to the U.S. Pat. No. 2,512,168, it discloses a pen with a trapezoid paper roll. The two ends of the paper roll are fixed on a shaft. The disadvantage of this prior art is the shape of the notepaper is not the same as the one we use and there are part of the paper left on two ends of the shaft, wasting paper. Furthermore, the Taiwanese patent No. 88204514 discloses a writing utility with notepaper. It is composed of an inner and a outer sleeves so as to make the rear end of the paper extends out of the penholder. Users tear off the paper according to the preset line while an anti-slip device is arranged nearby a guiding slot for easier retrieving next time. Although the paper is unrolling easier, it's difficult to withdraw the paper into the housing. On the other hand, the length of the notepaper is fixed, impossible to adjust. In conclusion, there are three types of design for conventional pens housing a supply of paper. The first is adapted the inner pushing force coming from the rotation of the central shaft of paper roll. The second adapts the pulling force applied on the end of the paper roll. The last takes the mixing of pushing force and pulling force. However, the conventional designs always focus on the control of the free end or fixed end of the paper roll. They provide no effective solution for preventing the paper therebetween from loosening, blocking or rewinding. Thus there is a need to provide a pen housing a supply of paper which is anesthetic, practical, and easy for retracting or pulling out the paper roll.

SUMMARY OF THE INVENTION

It is therefore a primary object of the present invention to provide a paper dispenser by which the loosening, blocking, twisting or rewinding of the paper roll can be prevented. It is practical and convenient to unwind or turn back the paper.

A further object of the present invention is to provide a pen with a paper dispenser by which the loosening, blocking, twisting or rewinding of the paper roll can be prevented. It is practical and convenient to release or retract the paper.

In order to achieve the primary object mentioned above, the present invention provides a paper dispenser for accommodating a paper roll. The paper dispenser is composed of a tube with an elongate lateral opening and a cavity, a central shaft disposed inside the cavity, a set of spring for shaft with one end inserted and fixed on the central shaft while the other end is connected with the beginning end of the reel for fixing it. The spring set for shaft rotates in accordance with the central shaft and can release the paper through the lateral opening or furl the paper back to the cavity. And an annular leafspring set for the paper roll is installed between the reel tube and the spring set for shaft.

BRIEF DESCRIPTION OF THE DRAWINGS

The accomplishment of the above-mentioned object of the present invention will become apparent from the following description and its accompanying drawings which disclose illustrative an embodiment of the present invention, and are as follows.

DETAILED DESCRIPTION OF THE PREFERRED EMBODIMENT

Figure 1:
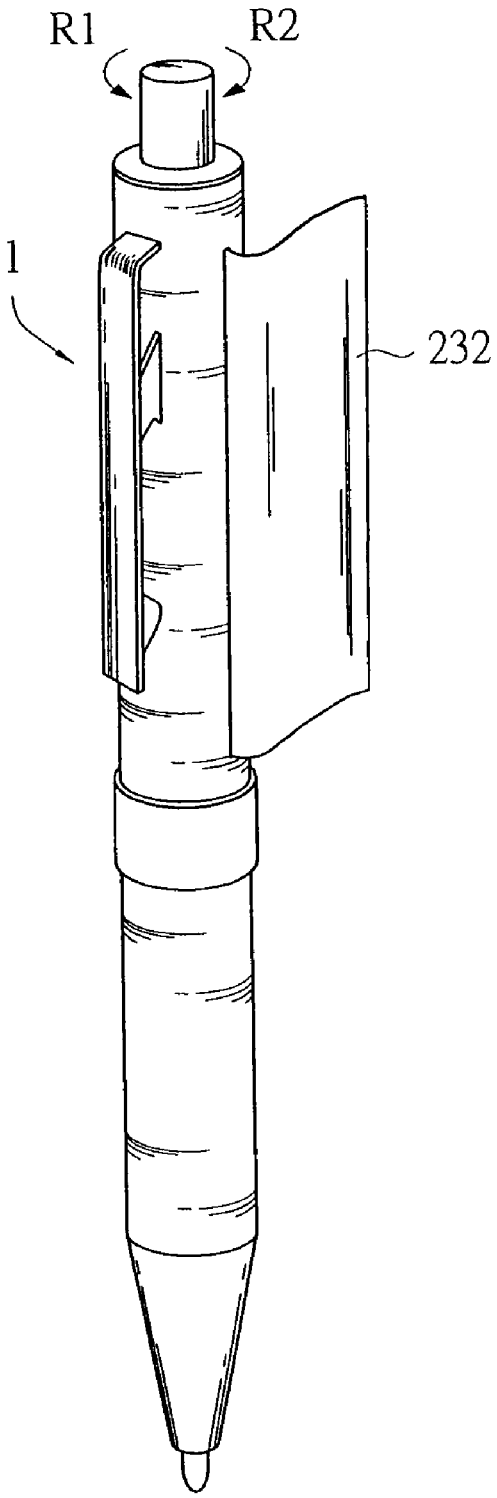
FIG. 1 is a perspective view of a pen with a paper dispenser in accordance with the present invention.
Figure 2:
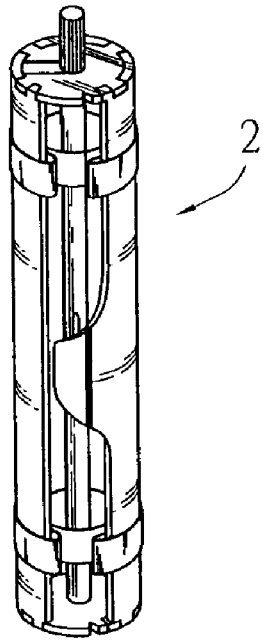
FIG. 2 is a schematic drawing of the paper dispenser relating to the present invention.
Figure 3:
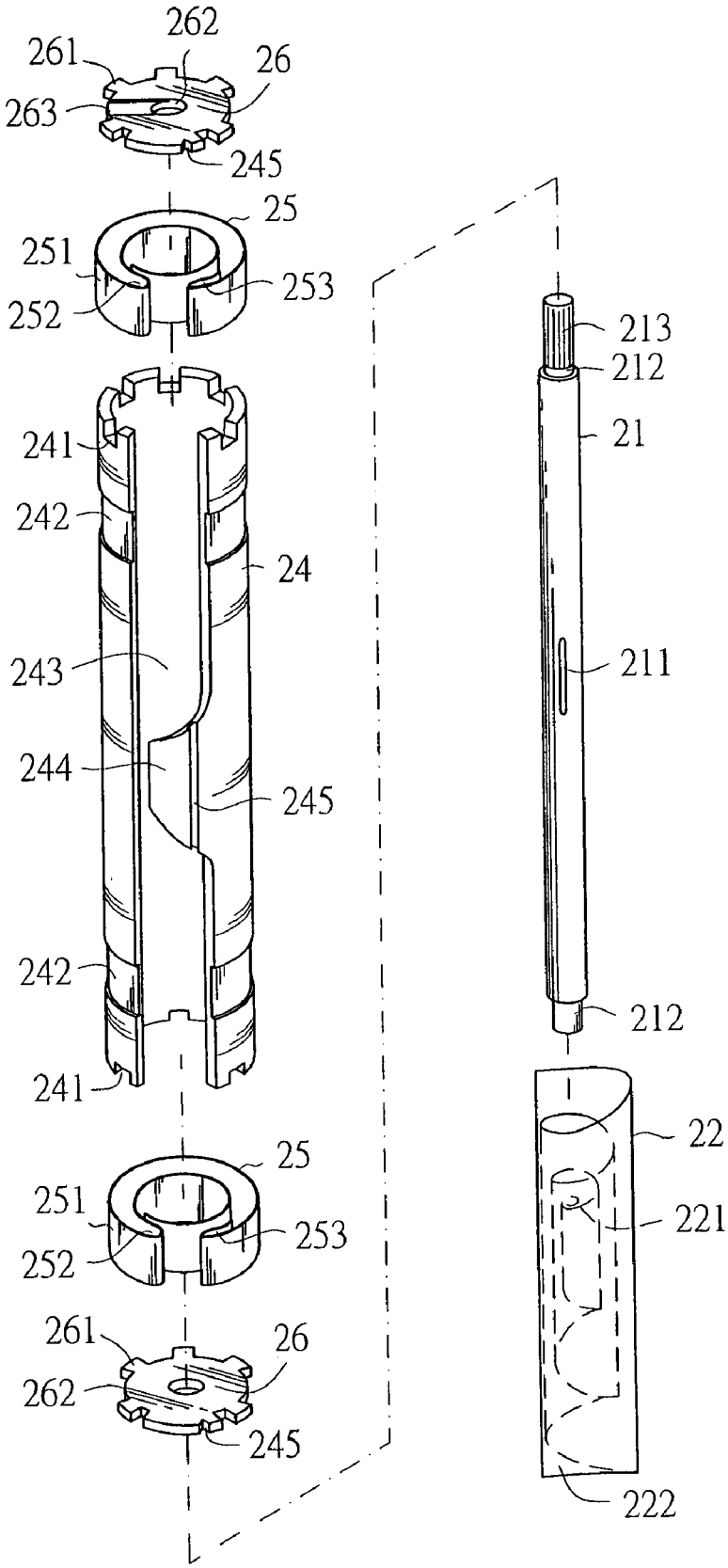
FIG. 3 is an explosive view of the present invention.

Refer from FIG. 1 to FIG. 6, a paper roll dispenser 2 having a tube 24 being loaded with a paper roll 23 with an elongate lateral opening 243, an arcuate elastic piece 244, a cavity, a central shaft 21 disposed in the cavity inside the tube 24, a spring set for shaft 22 with one end inserted and fixed on the central shaft 21 and the other end-rear end 222 connected with an initial end 231 of the paper roll 23, and an annular leafspring set 25. The spring set for shaft 22 rotates in accordance with the central shaft 21, for extending and retracting the free end of the paper roll 23 through the elongate lateral opening 243 and the arcuate elastic piece 244. It also pushes the paper roll 23. The annular leafspring set 25 is installed between the tube 24 and the spring set for shaft 22 for retracting the paper roll 23 inwards.

By the design of the present invention, it can be mass-produced and the paper roll dispenser can be replaced as convenient as refills. The present invention is composed of a central shaft 21, a spring set for shaft 22, a paper roll 23, a tube 24, an annular leafspring set 25, and two tube caps 26. A gap 211 is arranged on the middle part of the central shaft 21, two positioning pins 212 are set on two ends of the central shaft 21 and a ratchet wheel 213 is arranged on top of the upper positioning pins 212. While the spring set for shaft 22 is made from a curled elastic piece whose initial end is narrower than the rear end 222. A curved plane 221 on the initial end of the spring set for shaft 22 is inserted and fixed to the gap 211 on the central shaft 21, then the spring set for shaft 22 is winded along the counter clockwise direction so as to form a close ring. The outer edge of the rear end 222 is connected to the inner side of the initial end 231 of the paper roll 23 for securing. The spring set for shaft 22 features on that it has elasticity in radical direction which can adjust the cavity inside the paper dispenser while the paper roll 23 is pulled out or brought back. In addition, the elasticity in radical direction of the spring set for shaft 22 also provides supporting for the inner layer of the paper roll 23, prevent the occurrence of the gap and the twisting of the paper while being pulled back.

The tube 24 is made of material with high ductility and elasticity. On the upper and lower end of the tube 24 is disposed a plurality of slot mortise 241. Two shallow slots 242 are mounted on the outer wall of the tube 24 while the elongate lateral opening 243 is set thereof longitudinally, parallel to the axis of the tube 24. The arcuate elastic piece 244 projecting from the lateral side of the elongate lateral opening 243 is integrated with the wall of the pen, the thickness thereof is decreasing outwards to form a curve. A longitudinal U-shaped guiding slot 245 is arranged on the wide part of the arcuate elastic piece 244 for matching with guiding rail 313 of the upper penholder. The rear end of the arcuate elastic piece 244 rests against the outer layer of the paper roll 23 by elasticity so as to make the rear end of the paper roll 232 stretches out from the elongate lateral opening 243 while turning around the central shaft 21 reversely.

The annular leafspring set 25 made of a leaf spring having an outer ring 251 and an inner ring 252. The rear end of the outer ring 251 bends inwards to form a clip 253 for clipping on the lateral end of the elongate lateral opening 243 and encircling the shallow slot 242 in counterclockwise direction. The other end of the annular leafspring set 25 extends inside the tube 24 and form an open inner ring 242 in clockwise direction. The compressing elasticity in radical direction of the annular leafspring set 25 prevents the loosing of the paper roll 23 and adjusts the cavity inside the tube 24. Moreover, the width of the inner ring 252 is far more smaller than that of the paper roll 23 so that the contact area therebetween is also quite smaller. When the paper roll 23 is released or turned back, the friction therebetween is reduced. The annular leafspring set 25 can be arranged nearby the top and bottom ends of the paper roll 23 respectively so as to restrain the circumference thereof.

A tube cap 26 whose diameter is a bit longer than the outer diameter of the tube 24 is installed on the top and bottom ends of the tube 24. A plurality of tenon 261 are arranged on the circumference of the tube cap 26 for matching the mortise 241 and securing the tube cap 26 on the tube 24. One of the tenons 261, located near the position matching with the elongate lateral opening 243, also having a guiding slot 245. When the top and bottom tube caps 26 are assembled with the tube 24, the guiding slots 245 thereof align with that of the tube 24 so as to match and position the guiding rail 313 of upper penholder. Furthermore, the width of the guiding slot 245 is a bit larger than the thickness of the guiding rail 313 for keeping the elasticity of the elastic piece 244. A round hole 262 is mounted on the center of the tube cap 26 for insertion and positioning of the positioning pin 212. The top of the upper tube cap 26 forms an angle with the left side of the guiding slot 245. A tube cap shallow slot 263 is arranged between the round hole 262 and the circumference of the tube cap 26 for arranging and positioning a brake 321. It also provides the brake 321 supporting in lateral side while the brake 321 is used to stop the ratchet wheel 213 for tearing off a piece of paper.

Figure 4:
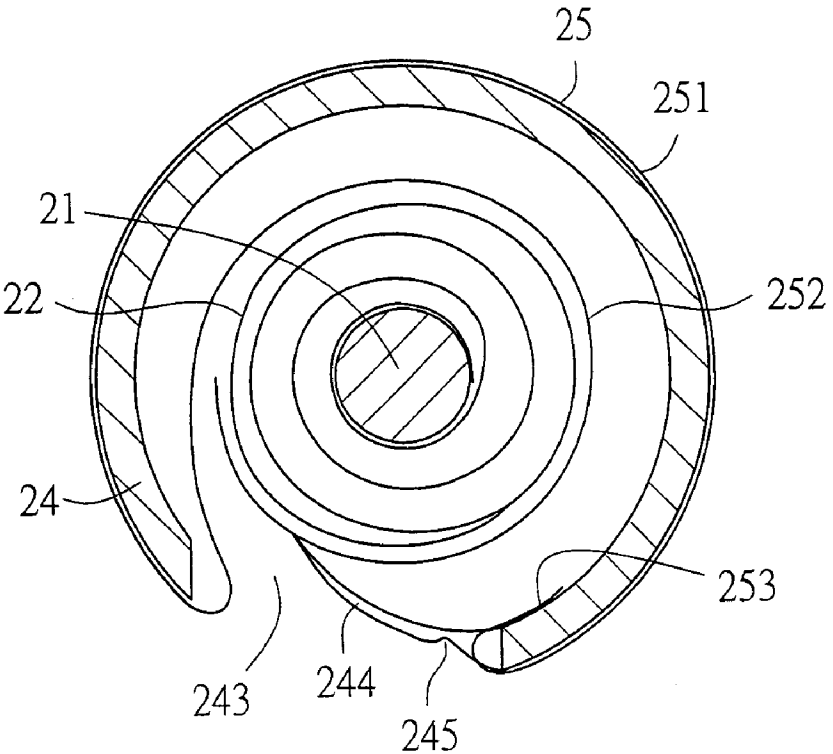
FIG. 4 is a cross-sectional view of the paper dispenser without the paper roll.

Refer to FIG. 4, it shows the corresponding position of the spring set for shaft 22 to the annular leafspring 25 and the balance of the torsion of each other when there is no paper inside the dispenser.

Figure 5:
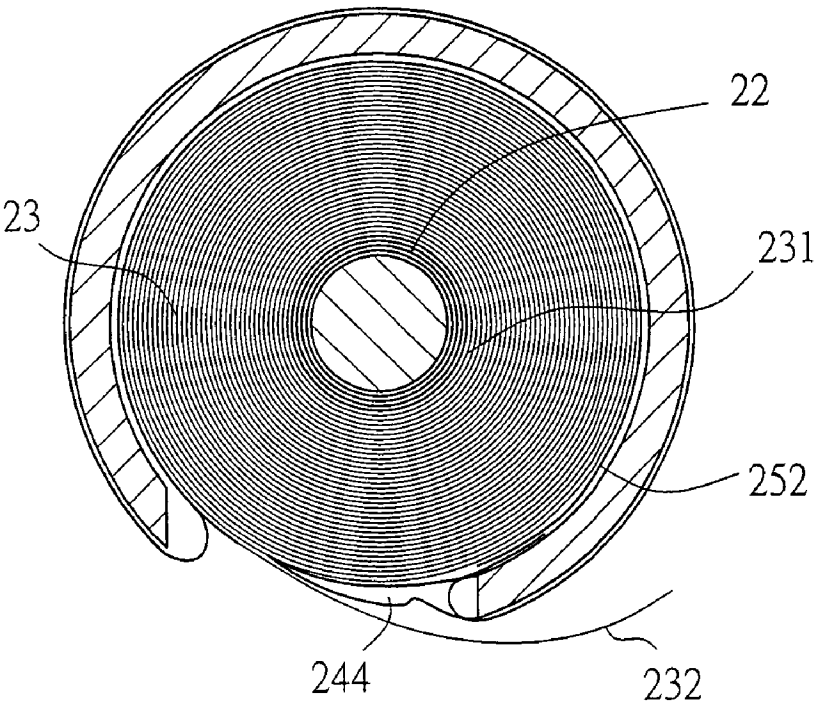
FIG. 5 is a cross-sectional view of the paper dispenser with the whole paper roll, before being released.

Refer to FIG. 5, before the paper roll 23 is pulled out the dispenser 2, each layer of the paper roll 23 is compressed without any gap therebetween. The paper is pulled out easily through anticlockwise rotation R1.

Figure 6:
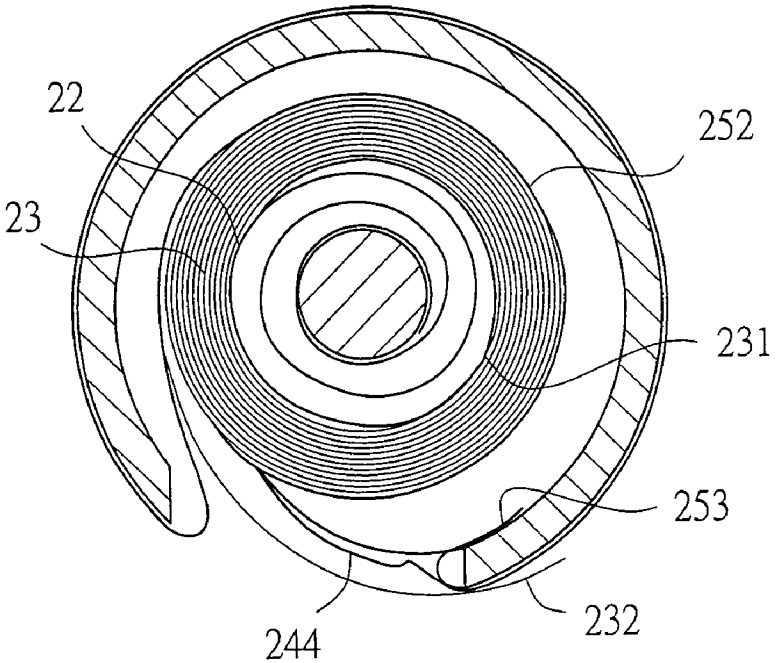
FIG. 6 is a cross-sectional view of the paper dispenser after the paper roll is pulling out.

Refer to FIG. 6, it reveals the inside of the tube 24 after the paper is threaded out of the dispenser (housing) 2. The number of the layers of the paper roll is reduced. However, the paper layers still get close due to the radial-directional stretching force of the spring set for shaft 22 and the compressing force of the inner ring 252 of the annular leafspring 25. Thus outer pushing force can be continuously transmitted from the initial (leading) end of the paper roll 231, through each layer of paper to the rear end of the paper roll 232, the paper roll 23 is released smoothly. On the other hand, the released paper can also be turned around reversely into the dispenser 2 by the inwards pulling force of the clockwise rotation R2.

Figure 7:
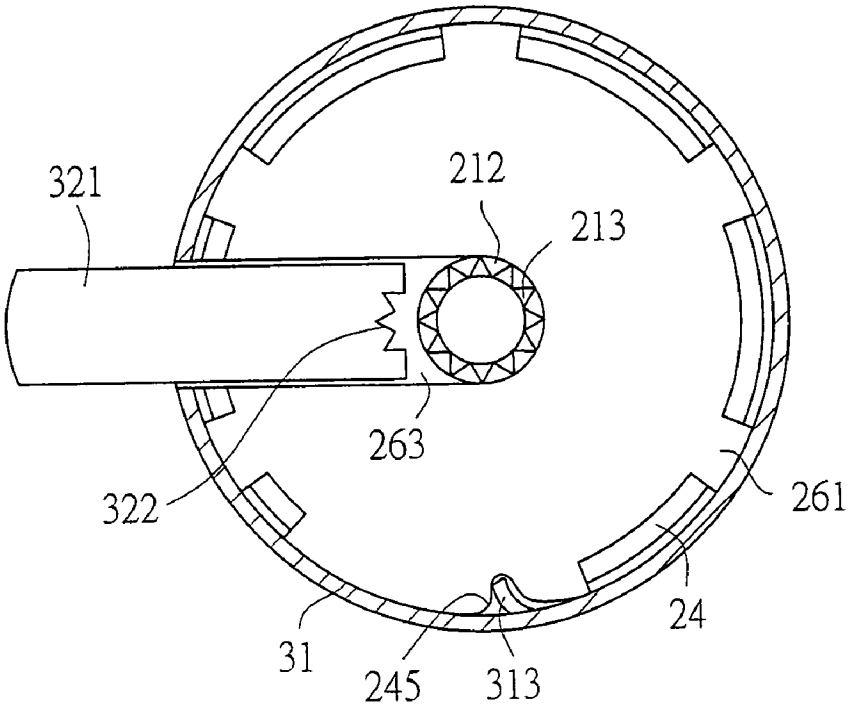
FIG. 7 is a cross-sectional view of the upper penholder of the present invention.
Figure 8:
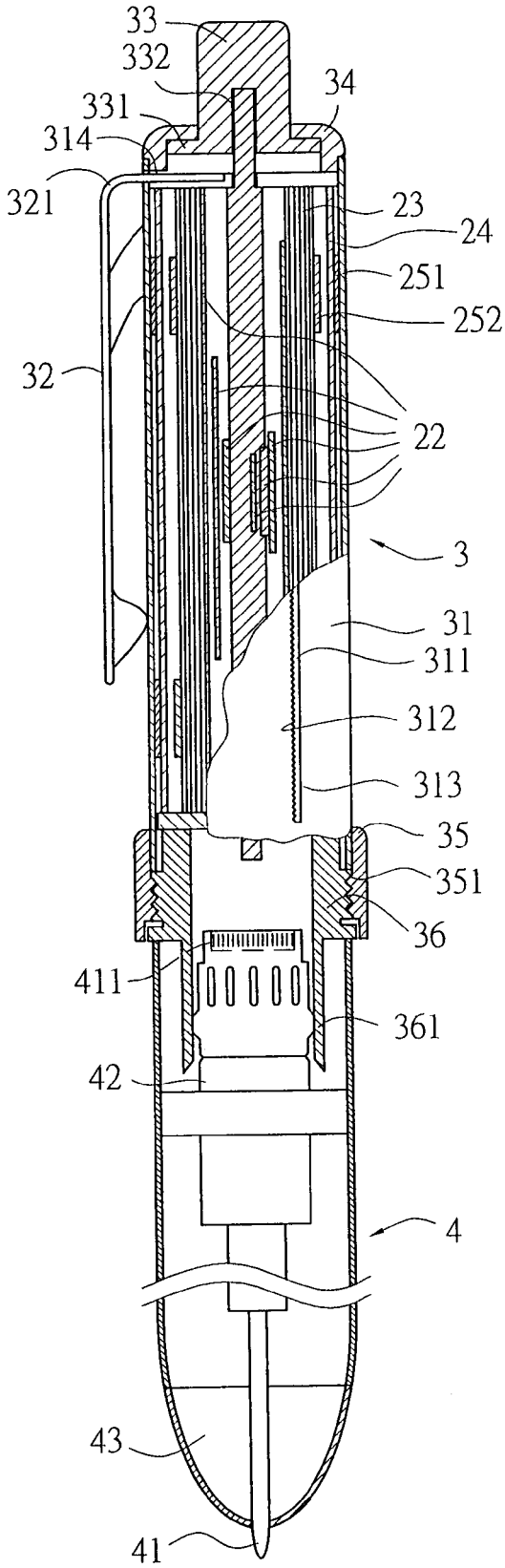
FIG. 8 is an explosive view of a pen with a paper dispenser in accordance with the present invention.

Refer to FIG. 7 & FIG. 8, an upper penholder 3 having a penholder wall 31, a pocket clip 32, a shaft brake 321, a rotation cap 33, a cover for upper penholder 34, a middle ring for penholder 35, and a fixing thread 36.

A longitudinal exit slot 311 is arranged on the wall 31 of the upper penholder 3 whose length is equal to that of the dispenser 2. A serrated blade 312 is arranged on one lateral side of the longitudinal exit slot 311 for tearing off the paper while the other lateral end of the exit slot 311 is a guiding rail 313 bending a bit inwards which can insert through the guiding slot 245 of the top tube cap 26, the guiding slot 245 on the arcuate elastic piece 244, the guiding slot 245 of the bottom tube cap 26 so that the opening of the paper roll dispenser 2 aligns with the exit slot 311 of the upper penholder 3.

Moreover, the guiding rail 313 bending a bit inwards shields the gap between the outer wall of the dispenser 2 and the inner wall of the upper penholder 3 for preventing the misleading of the rear end of the paper roll 23. Furthermore, a pocket clip 32 is attached on the outer wall of the exit slot 311 with a fine opening 314 on top side thereof for insertion of the shaft brake 321 into the upper penholder 3. The shallow slot 263 can hold and position the shaft brake 321. The shaft brake 321 made of elastic material is integrated with the pocket clip 32 with an angle therebetween. A serrated braking part 322 keeps a certain distance with the ratchet wheel 213 so as to avoid the impeding of the rotation of the central shaft 21. By the elasticity thereof, when the shaft brake 321 is pressed, the serrations of the serrated braking part 322 engages with the ratchet wheel 213 of the central shaft 21 to block the central shaft 21 so as to prevent the releasing of the paper while it is torn off. When the pressing is finished, the serrated braking part 322 leaves the ratchet wheel 213, back to the original position.

In practical application, a rotation cap 33 is arranged on top of the upper penholder 3 with a wing 331 which is being fixed in the cover for upper penholder 34 extending outwards thereunder. A round hole is in the center of the rotation cap 33 with a ratchet 332 mounted therein. The ratchet 332 engages with the ratchet wheel 213 on top of the central shaft 21. When the rotation cap 33 is rotated in counter clockwise R1 or clockwise direction R2, the central shaft 21 is also drived and the paper roll 23 is released or rewound by the inward pushing force or inward pulling force.

The middle ring for penholder 35 is attached on outer wall of the lower part of the upper penholder 3. A female-threaded portion 351 is arranged on the lower part of the middle ring for penholder 35 for locking with a male-threaded portion of the fixing thread 36 on the paper dispenser 2. When replacing the paper dispenser 2, just wind the fixing thread 36. A sleeve 361 is installed on the lower part of the fixing thread 36 for connecting a linking device 42. The center of the linking device 42 is screwed with a refill 41 having a refill cap 411 on top thereof. A pen tip 43 is set on bottom of the penholder.

The present invention has following applications:

1. Reversely rotate the cap and release the paper to the necessary length, then press the shaft brake for tearing off the paper. The piece of paper can be used as a notepaper for writing something.
2. The upper and lower penholders are separated from opposite direction easily and quickly. Then rotate the cap on the upper penholder in counterclockwise direction for providing paper to write and turn the paper back by rotating the cap in clockwise direction. The pen dispenser is used as a booklet.
3. If more paper is needed, once the paper is released by the rotation of the cap, pull the read end of the paper outwards for saving the operation time.
4. The paper can be printed with a lot of information such as telephone numbers, addresses, yearly, monthly, weekly, and daily calendars unit conversion table and world timetable etc. It can also be printed with propaganda literature such as advertisements, users' manual or non-commercial publicity.

In summary, the present invention provides a pen with a paper dispenser that makes the pen more aesthetic, practical and easy for carrying. It can also solve the problem of prior arts such as loosing caused by the stress applied to the web, resistance of the paper roll caused by friction, twining caused by torsion, and rewinding. The function of the present invention is doubled by being rotated in opposite direction for releasing and rewinding paper. The present invention is easy separated into two independent parts-a paper dispenser and a pen. It's also easy assembled with triple function including a notepaper, a notebook and a writing utility. The paper dispenser and the refill are easily replaced.

It should be noted that the above description and accompanying drawings are only used to illustrated some embodiments of the present invention, not intended to limit the scope thereof. Any modification of the embodiments should fall within the scope of the present invention.

What is claimed is:

1. A paper dispenser for mounting a paper roll comprising:

a) a tube having an elongated lateral opening and a cavity;

b) a central shaft located in the cavity and having:

i) two positioning pins, one of the two positioning pins is located on each of a first end and a second end thereof; and ii) a ratchet wheel located on the first end thereof and selectively controlling a rotation of the central shaft;

c) a spring set located in the cavity and having a first end connected to the central shaft and a second end connected to a first end of the paper roll;

d) two annular leaf sets, each of the two annular leaf sets having an inner ring located between the tube and the spring set; and e) two tube caps, one of the two tube caps covering each of two opposing ends of the tube, wherein the central shaft is selectively rotated moving a second end of the paper roll between extended and retracted positions.

2. The paper dispenser according to claim 1, wherein each of the two tube caps has a round hole located in a center thereof, one positioning pin is inserted through the round hole of each of the two tube caps.

3. The paper dispenser according to claim 1, further comprising an arcuate elastic piece having a first end connected to a wall of the elongated lateral opening and a second end pressing against an outermost layer of the paper roll.

4. The paper dispenser according to claim 3, wherein each of the two tube caps and the arcuate elastic piece has a guide slot form therein.

5. The paper dispenser according to claim 3, wherein the spring set is a curled elastic piece having elasticity in a radial direction.

6. The paper dispenser according to claim 3, wherein each of the two annular leaf sets is an open ring spring made of a curled elastic piece having elasticity in a radial direction.

7. The paper dispenser according to claim 3, wherein the tube includes two shallow slots located on an outer periphery thereof, an outer ring of one of the two annular leaf sets being located in each of the two shallow slots.

8. The paper dispenser according to claim 3, wherein each inner ring of the two annular leaf sets includes an annular spring engaging an outer circumference of the paper roll.

9. The paper dispenser according to claim 8, wherein each annular spring is a predetermined size to control friction between each annular spring and the paper roll.

10. A pen for mounting a paper roll comprising:

a) a pen holder having a refill for writing; and b) a paper dispenser having:

i) a tube having an elongated lateral opening and a cavity;

ii) a central shaft located in the cavity and having two positioning pins and a ratchet wheel, one of the two positioning pins is located on each of a first end and a second end of the central shaft, the ratchet wheel is located on the first end of the central shaft and selectively controlling a rotation of the central shaft;

iii) a spring set located in the cavity and having a first end connected to the central shaft and a second end connected to a first end of the paper roll;

iv) two annular leaf sets, each of the two annular leaf sets having an inner ring located between the tube and the spring set; and v) two tube caps, one of the two tube caps covering each of two opposing ends of the tube, wherein the central shaft is selectively rotated moving a second end of the paper roll between extended and retracted positions.

11. The pen according to claim 10, further comprising a rotation cap located on a top of the ratchet wheel and controlling the rotation of the central shaft.

12. The pen according to claim 10, further comprising a shaft brake having a serrated braking part movable between engaged and disengaged positions, in the engaged position the serrated braking part engaging the ratchet wheel of the central shaft, and in the disengaged position the serrated braking part is spaced apart from the ratchet wheel of the central shaft.

13. The pen according to claim 12, wherein a first tube cap of the two tube caps located on a first end of the tube has tube cap slot, the shaft brake being located in the tube cap slot.

14. The pen according to claim 10, wherein each of the two tube caps has a round hole located in a center thereof, one positioning pin is inserted through the round hole of each of the two tube caps.

15. The pen according to claim 10, further comprising an arcuate elastic piece having a first end connected to a wall of the elongated lateral opening and a second end pressing against an outermost layer of the paper roll.

16. The pen according to claim 15, wherein each of the two tube caps and the arcuate elastic piece has a guide slot form therein.

17. The pen according to claim 10, wherein the spring set is a curled elastic piece having elasticity in a radial direction.

18. The pen according to claim 10, wherein each of the two annular leaf sets is an open ring spring made of a curled elastic piece having elasticity in a radial direction.

19. The pen according to claim 10, wherein the tube includes two shallow slots located on an outer periphery thereof, an outer ring of one of the two annular leaf sets being located in each of the two shallow slots.

20. The pen according to claim 10, wherein each inner ring of the two annular leaf sets includes an annular spring engaging an outer circumference of the paper roll.

21. The pen according to claim 10, wherein each annular spring is a predetermined size to control friction between each annular spring and the paper roll.

* * * * *